United States Patent [19]

Mercer

[11] Patent Number: 4,612,523

[45] Date of Patent: Sep. 16, 1986

[54] CIRCUIT BREAKER MECHANISM

[75] Inventor: James M. Mercer, Trenton, N.J.

[73] Assignee: Heinemann Electric Company, Lawrenceville, N.J.

[21] Appl. No.: 671,750

[22] Filed: Nov. 15, 1984

[51] Int. Cl.[4] ..... H01H 77/02

[52] U.S. Cl. ..... 335/26; 335/186

[58] Field of Search ..... 335/24, 25, 26, 27, 335/164, 186, 191

[56] References Cited

U.S. PATENT DOCUMENTS

| | | | |
|---|---|---|---|
| 3,593,235 | 7/1971 | Nicol | 335/186 |
| 3,680,014 | 7/1972 | Wilkinson | 335/26 |
| 3,938,065 | 2/1976 | Ellenberger | 335/24 |
| 4,023,127 | 5/1977 | Mune | 335/24 X |

*Primary Examiner*—George Harris

*Attorney, Agent, or Firm*—Dann, Dorfman, Herrell and Skillman

[57] ABSTRACT

An operating mechanism is provided for push-button circuit breakers. The breaker mechanism includes a frame and a pair of contacts supported relative to the frame which are displaceable relative to one another between an open and a closed position. A bell crank having a deflecting surface and a cam surface is pivotally mounted on the frame so as to pivot between a first and second stable position. A linkage assembly is coupled with the bell crank and at least one of the contacts and is displaceable so as to open and close the contacts. A push-button actuator is movably supported relative to the frame. The push-button actuator is adapted to engage the cam surface of the bell crank in its first stable position to displace the bell crank into the second stable position in order to displace the linkage assembly to close the contacts. The push-button actuator is also adapted to engage the deflecting surface of the bell crank in its second stable position so that the push-button actuator is deflected by the deflecting surface to prevent displacement of the bell crank from its second stable position. An electrical actuator is supported on the frame and is adapted to displace the linkage assembly under predetermined conditions to open the contacts and enable displacement of the bell crank from its second stable position back to its first stable position.

10 Claims, 10 Drawing Figures

FIG. 5
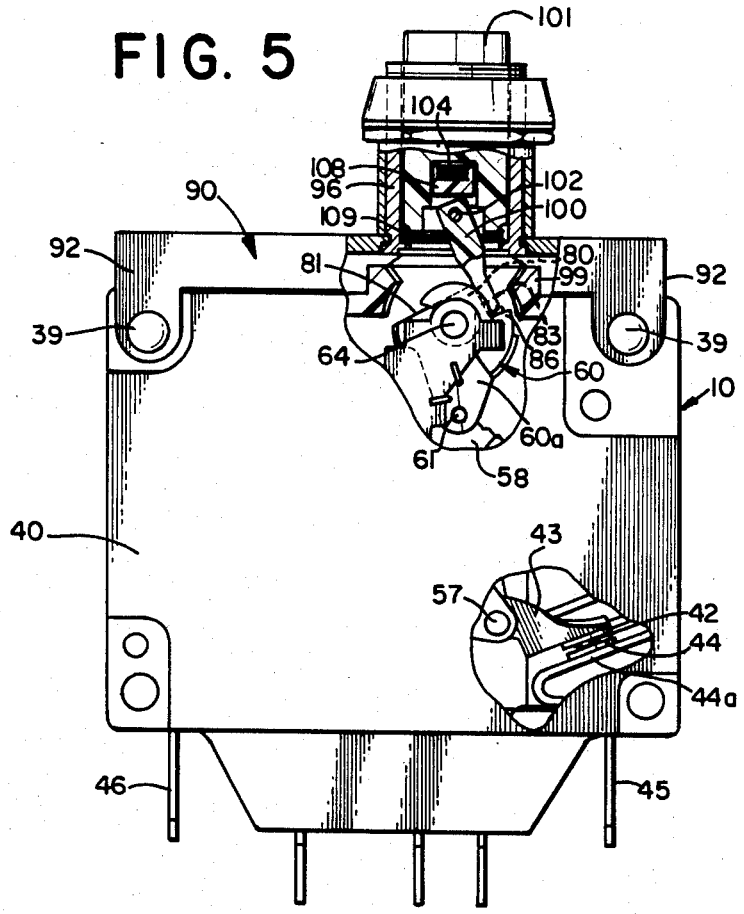
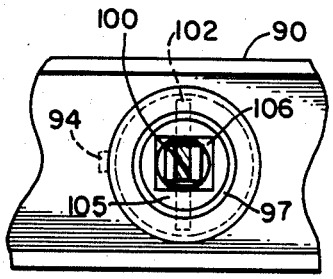
FIG. 3
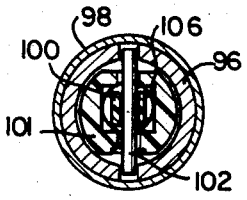
FIG. 4

CIRCUIT BREAKER MECHANISM

FIELD OF THE INVENTION

The present invention relates to a circuit breaker mechanism and, more particularly, to an actuating mechanism for push-button type circuit breakers.

BACKGROUND OF THE INVENTION

Many uses and applications exist for push-button circuit breakers. Conventional push-button circuit breakers include a depressible push-button to actuate the breaker contacts between open and closed positions. In normal circumstances, the circuit breaker must not only automatically interrupt power under overload conditions but must also interrupt power under the control of a user. For this purpose, the push-button actuating mechanisms of conventional push-button breakers switch the contacts of the breaker both from the open to the closed position and from the closed to the open position.

In some applications the manual interruption of power is not always desired. For example, when using safety lighting or safety equipment, it is often desirable to eliminate the capability for any manual interruption of power to avoid any inadvertent shutdown of the system.

In accordance with the present invention, a unique mechanism for a push-button circuit breaker is provided which effectively prevents manual interruption of power while still permitting interruption under overload conditions.

SUMMARY OF THE INVENTION

In accordance with the present invention, a circuit breaker mechanism is provided. The mechanism includes a frame and a pair of contacts supported relative to the frame. The contacts are displaceable relative to one another between an open and a closed position. The mechanism also includes a bell crank pivotable on the frame between a first and a second stable position. The bell crank includes a deflecting surface and a cam surface. A linkage assembly is coupled with the bell crank and with at least one of the contacts and is displaceable to open and close the contacts.

A push-button actuator is so supported that it can move relative to the frame. The actuator of the push-button engages the cam surface of the bell crank in the first stable position to displace the bell crank from its first stable position into its second stable position so as to displace the linkage assembly to close the contacts. The actuator of the push-button also engages the deflecting surface of the bell crank in its second stable position so that the actuator is deflected by the deflecting surface of the bell crank to prevent displacement of the bell crank from its second stable position.

To trip the circuit breaker open under overload conditions, an electrical actuator is provided on the frame for displacing the contacts from the closed position to the open position under predetermined conditions. The electrical actuator collapses the linkage assembly under the predetermined conditions to allow the contacts to open and to allow the bell crank to return from the second stable position back to its first stable position.

BRIEF DESCRIPTION OF THE DRAWINGS

The foregoing summary, as well as the following detailed description of the preferred embodiment of the present invention, will be better understood when read in conjunction with the appended drawings, in which:

FIG. 3 is a sectional view taken along line 3—3 of FIG. 1 illustrating the push-button actuator;

FIG. 4 is a sectional view taken along line 4—4 of FIG. 1 illustrating the push-button actuator;

FIG. 5 is a side elevational view, similar to FIG. 1, partially broken away illustrating the circuit breaker mechanism with the bell crank positioned with the contacts in the closed position; and FIG. **6*a*–6*e*** are schematic representations showing the cooperation between the push-button actuator and the bell crank in sequence.

DESCRIPTION OF THE PREFERRED EMBODIMENT

Figure 1:
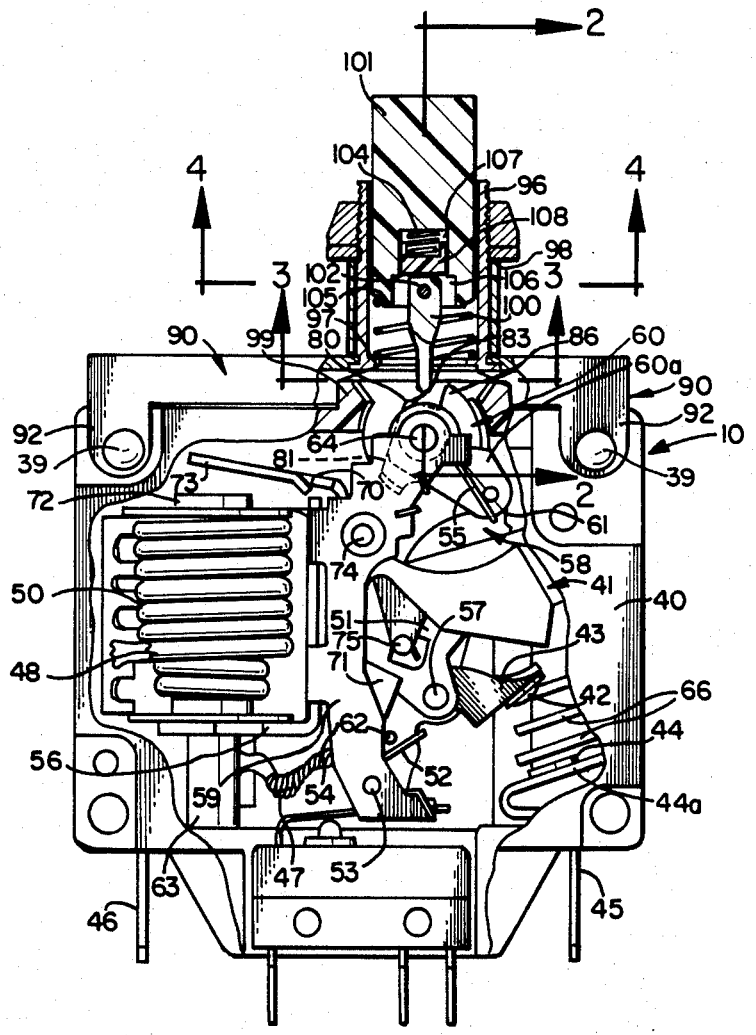
FIG. 1 is a side elevational view, partially broken away, of the breaker mechanism in accordance with the present invention positioned with the contacts of the breaker in the open position.

Referring to the Figures and particularly FIG. 1, a circuit breaker generally designated 10, is depicted having a plastic outer casing 40 constituting part of the frame and housing an internal circuit breaker mechanism 41. Considering the electrical circuitry, the breaker mechanism 41 comprises a movable contact 42 which is carried by a pivoted arm 43. The movable contact is engageable with a stationary contact 44 supported on housing by a resilient contact support **44*a* which is connected with an external terminal 45 of the breaker. The movable arm 43 is connected by a flexible conductor 47 to one end of a coil 48 forming a part of an electromagnetic actuating device 50. The electrical circuit of the circuit breaker is completed by connecting the other end of the coil 48 to external terminal 46 of the breaker. The electromagnetic actuating device 50, when current increases to a predetermined level for a predetermined time functions to trip open the contacts 42 and 44** to interrupt the circuit.

The breaker includes an internal frame 59 fixed relative to the housing 40. The frame is provided by a channel shaped stamped and folded sheet metal member providing two spaced support plates 54. The channel shaped member is integrally formed with an L-shaped support 56 which carries and supports the coil 48 of the electromagnetic device 50 in fixed position. Within the coil 48 is viscous fluid containing time delay tube 63 forming a part of the electromagnetic device 50 supported on the frame 59. As is conventional, tube 63 houses a spring biased magnetic core (not shown) movable against a spring and the retarding action of the viscous fluid to provide a calibrated time delay before tripping of the breaker mechanism on overloads.

The contact arm 43 rotates about a pin 53 extending between the spaced plates 54 of the frame. The ends of the pin 53 extend into holes formed in the opposed sidewalls of the casing to properly position and support the mechanism 41 inside the casing 40. The pivotable contact arm 43 is biased by a spring 52 carried on pin 53 toward an open position of the contacts 42 and 44. Stop pin 62, carried by the movable arm 43, has end portions which engage the edges of spaced plates 54 of the frame to limit the opening movement of the arm 43, as shown in FIG. 1.

The pivotable contact arm 43 is also connected by a pin 57 to a link of a two link toggle assembly 51. The toggle assembly 51 at its other end is, in turn, pivotally connected by a pin 61 to an arm 60*a* of a bell crank 60, preferably formed of a molded resinous material, which rotates about a pin 64 fixed at its ends to the spaced frame plates 54. The rotatable arm 60*a* together with the toggle linkage assembly 51 and contact arm 43 couple the bell crank 60 with the movable contact 42 enabling the contacts to be closed by a push-button actuator when the links of the toggle are locked together by a latching mechansim 58.

The bell crank 60 has a hub which provides a contoured hub surface and is pivotally supported on the frame by pivot pin 64. The contoured hub surface has an apex 80 which divides the hub surfaces into a deflecting surface 81 on one side of the apex and a cam surface 83 terminating in a shoulder, or some other form of stop, on the other side of the apex. Depending on the position of bell crank 60, either the deflecting surface 81 or the cam surface 83 will be engaged by an actuating pawl element 100 of a manual actuator. When the cam surface 83 is presented to the actuating pawl element 100, as to be described hereinafter, it will cause a rotation of the bell crank about pin 64 ultimately closing the contacts through the rigid toggle linkage assembly 51. When the deflecting surface 81 is engaged, it merely deflects the actuating pawl element 100 to prevent any pivoting motion.

Figure 2:
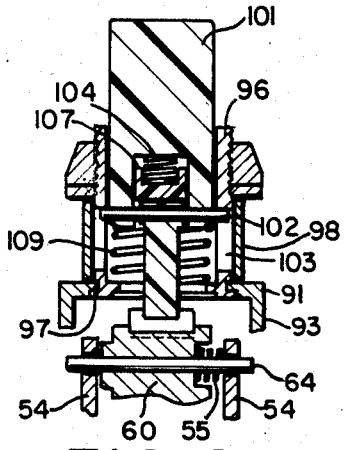
FIG. 2 is sectional view taken along line 2—2 of FIG. 1 illustrating the push-button actuator and a portion of the bell crank.

As seen in FIG. 2, a spring 55 is coiled on the pivot pin 64 and has one end attached to one of the frame plates 54 and the other end to the bell crank 60 to bias the bell crank 60 to the contacts "open" position, as illustrated in FIG. 1. The crank 60 is normally held in one or the other of two stable positions: the contacts "open" position illustrated in FIG. 1 by stop means pin 62 contacting frame 54, thereby limiting rotation imposed by spring 55; or the contacts "closed" position illustrated in FIG. 5 wherein the rigid toggle linkage assembly is moved over center and against a stop. Motion of the total linked structure is stopped when pin 61 on bell crank 60 abuts frame plates 54.

The push-button actuator for the breaker is supported on a channelled bracket 90 mounted on casing 40. The bottom of the channel bracket is spaced from and runs parallel to the adjacent upper surface of the casing 40 of the circuit breaker 10 to accommodate a tubular element 96 defining an opening into the casing and projecting outwardly from the casing. The sidewalls of the bracket channel are extended to form four tabs 92 which straddle and fit into corner depressions on opposite sides of the casing 40. The tabs 92 have holes aligned with the holes through the solid upper corner portions of the casing 40 through which fasteners are passed to connect the bracket 90 to the casing 40. A tubular element 96 is mounted on the bracket 90 with its axis generally perpendicular thereto. Aligned openings in the bracket and the tubular element provide access to the interior of the casing.

The tubular element 96 guides a slidably fitting cylindrical push-button 101. The push-button is the manual actuator portion of an assembly which includes an actuating pawl 100. The pawl 100 is pivotally connected at one end within a recess in an internal end of the push-button 101 by means of pin 102 extending diametrically across the push-button cylinder. The pawl 100 is preferably a bar extending longitudinally along the axis of the push-button when in stable rest position. As illustrated in FIG. 1, although uniform in width, the pawl has a larger thickness dimension at the end through which the pin 102 supporting it to push-button 101 passes. A tapered section joins the support end to a narrower actuating end which terminates in a rounded tip to facilitate movement along surfaces of and actuation of the pivotal bell crank 60 with which it cooperates. The pawl 100 must be sufficiently long and properly positioned to move the bell crank 60 from the contacts open to the contacts closed position within the allowable movement of the push-button. As the contacts are being moved from open to close condition through the then rigid toggle linkage assembly 51 the pawl 100 stays in engagement with the shoulder 86 until the bell crank pin 61 is displaced through and beyond imaginary straight line drawn between the pins 64 and 57. At this time as the linkage passes the over-center point, the spring 52 resisting the rotation of contact support arm 43 acts to aid continuing rotation of the bell crank 60 until pin 61 contacts the frame 54 and stops rotation.

Considering the movement of the push-button 101 within the tubular element 96, as best seen in FIGS. 2 and 4, the ends of the pin 102 are carried in slots 103 formed in the tubular element 96. The respective ends of the slots 103 limit axial movement of the pin 102 and the push-button 101. The pin 102 in the slots also prevents rotation of the push-button 101 and the pawl element 100 relative to tubular element 96. A cylindrical sleeve 98 surrounds the tube 96 to prevent the pin 102 from escaping from the slots 103. The push-button 101 is urged to its outermost position by a return helical compression spring 109 positioned between a groove 105 around the inner end of the push-button 101 and a shoulder on flange 97 projecting radially inwardly from the innerwall of tubular element 96.

The depressible push-button 101 has formed in its inner end a rectangular recess 106 and in the bottom of that is a second recess 107 of cylindrical form which is axially aligned with recess 106. Within the rectangular recess 106 is pivot pin 102 for the pawl 100 and the supported square end of the pawl which, extends above the pin 102. The dimensional width of the rectangular recess 106 in the direction parallel to the axis of the pin 102 is sufficient to accommodate the pawl 100. The transverse dimension is sufficient to permit the pawl element to pivot about the pin 102 sufficiently to perform its actuating function, as illustrated in FIGS. 6*c* and 6*e*. The cylindrical recess 107, which extends further into the push-button 101 from recess 106, has a diameter which is slightly larger than the dimensional width of the top of the pawl 100 in the direction perpendicular to the axis of the pin 102. The exact diameter is not critical so long as it is large enough to permit the pivotal movement of the pawl element 100 partially into the recess 106 as illustrated in FIGS. 5 and 6*a* through 6*e*.

A centering mechanism comprises a cylindrical centering piston 108 slidably accommodated within the cylindrical recess 107 and a helical centering compression spring 104, located between the piston 108 and the bottom of recess 107. The upper surface 100*a* of the pawl element 100 acts as a stop for the piston. The piston 108 has a planar surface at its lower end abutting the upper adjacent planar surface of the pawl element 100. The centering spring 104 is partially compressed during assembly of the push-button 101, piston 108, and pawl 100 to insure that pressure is continuously applied through the piston 108 to the upper planar surface 100*a* of the pawl 100 to tend to axially align the pawl 100 along the longitudinal axis of the tubular element 96. When out of contact with the bell crank, pawl 100 lies in a plane through its support pin 102 and the pin 64 rotatably supporting the bell crank 60. As seen in FIGS. 5, 6*b*, 6*c* and 6*e*, pivotal motion of the pawl 100 causes the corners of the top to move the piston 108 which further compresses the centering spring 104 to increase the force acting to recenter the pawl 100 to the position of FIGS. 1, 6*a* and 6*d*.

Figure 6A:
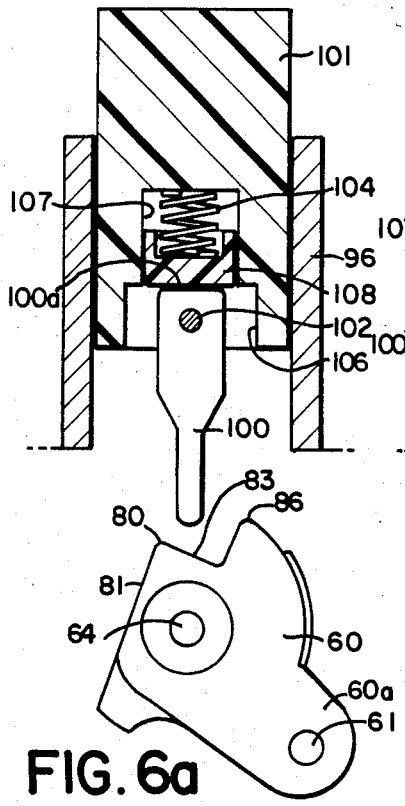
Figure 6B:
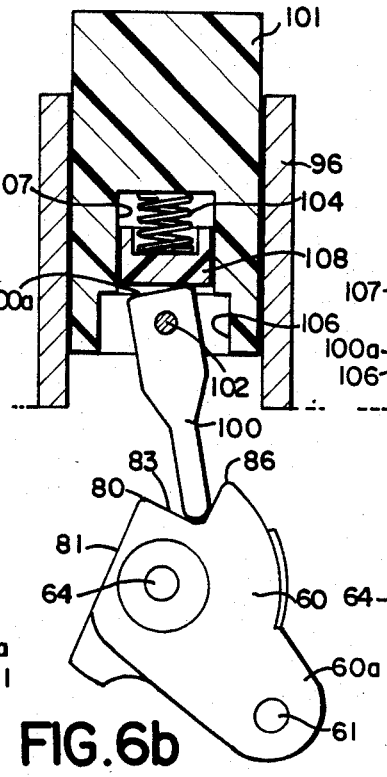
Figure 6C:
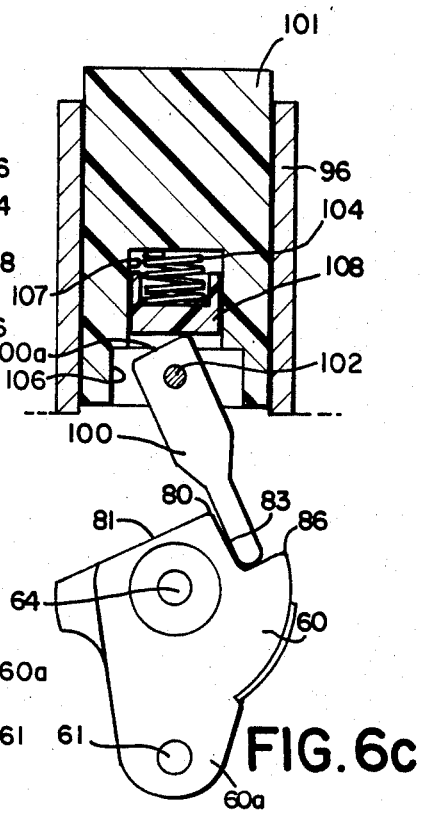

In operation, assuming the contacts 42 and 44 and the pivotal bell crank 60 to be in the contacts "open" position, as illustrated in FIG. 1, before depressing the push-button 101, the pawl 100 and bell crank 60 are in the position of FIG. 6*a*. When the push-button is manually depressed, the pawl 100, moves into contact with cam surface 83. As illustrated in FIG. 6*b*, the pawl 100 engages and is deflected by cam 83 into the shoulder 86. After engagement of the shoulder 86 by the pawl 100, further downward movement of the push-button causes the pawl 100 to drive the bell crank 60 in rotation about pin 64 against the bias of spring 55. The movement of the push-button 101 and the pawl 100 downward must be sufficient in driving the arm 60*a* of the bell crank 60 to move the rigid toggle assembly 58 until the pin 61 has gone overcenter between an imaginary line connecting pins 64 and 57. Further, the downard movement of the actuating pawl and the rotation of the bell crank 60 toward the contacts closed position are limited by the abutment of pin 61 with the frame plates 54. By depression of the push-button 101, the bell crank 60 is pivotally driven to the contacts closed position, as illustrated in FIG. 6*c*, where it is held in position by the locked rigid toggle assembly 58. The rotational movement of the arm 60*a* is transmitted via the interconnecting pin 61 to the toggle assembly 58 which moves the contacts 42 and 44 into the contacts closed position, as illustrated in FIG. 5. To minimize any arc that may form between the contacts upon opening, a plurality of U-shaped magnetizable grids 66 are placed adjacent the movable contact 42 and the stationary contact 44.

In pivoting the bell crank, as the actuating end of the pawl 100 moves along the cam surface 83 and drives the bell crank 60 through abuttment with shoulder 86, the pawl 100 itself pivots about pin 102 until it reaches the position shown in FIGS. 5 and 6*c*. During this pivoting motion, the upper corner of the pawl 100 bears against the plunger 108 forcing it upward against the pressure of the spring 104, as can be seen in FIGS. 5, 6*b* and 6*c*.

Figure 6D:
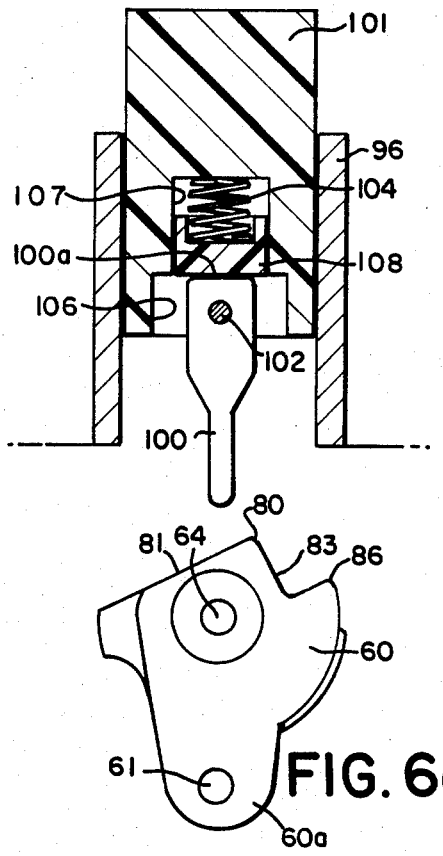
Figure 6E:
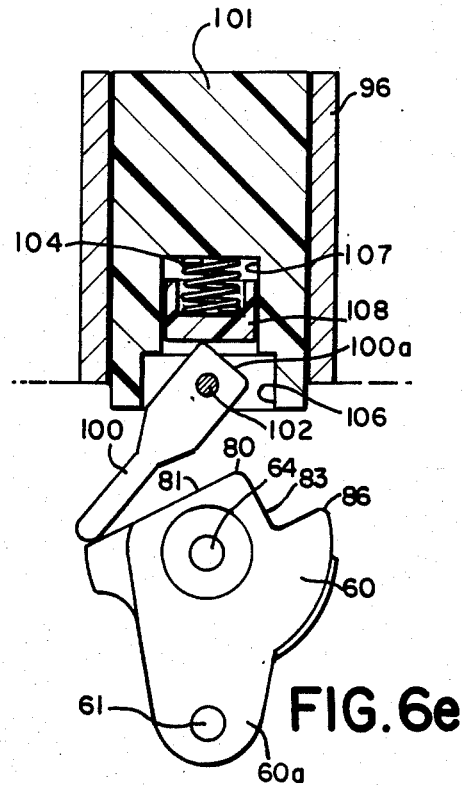

After the push-button 101 is released, the push-button 101 will retract to the position of FIG. 6*d* under the bias of return spring 109. As the push-button 101 returns to its retracted position, plunger 108 acts on the flat top surface of the pawl 100 to restore the axially aligned position of FIG. 6*a* as the pawl 100 moves out of engagement with the bell crank 60.

When the circuit breaker 10 is in the contacts "closed" position, as illustrated in FIG. 5, the push-button 101 may again be depressed. As the push-button is depressed, the pawl 100 moves against deflecting surface 81 of the bell crank 60 which is presented to the pawl, since bell crank 60 is in its contact closed position, as shown in FIGS. 6*d* and 6*e*. Further depression of the push-button causes the actuator portion of the pawl 100 to move along the deflecting surface 81 of the bell crank 60 without engaging a stop or shoulder even when fully depressed as shown in Fig. 6*e*. Since the bell crank 60 cannot rotate, it cannot move the toggle mechanism 58 to the "open" position of the contacts 42 and 44. In short, the deflection of the pawl element 100 by the deflecting surface 81 prevents the manual switching of the breaker from the contacts closed position to the contacts open position. Upon release of the push-button 101, the pawl 100 retracts under the bias of return spring 109. The retracted push-button, when the contacts are closed, is shown in FIG. 6*d*.

The operation of the linkage assembly 58 and the electromagnetic device 50 is specifically set forth in U.S. Pat. No. 3,329,913 which is incorporated herein by reference. For purposes of brevity, it will only be generally described herein. When the crank arm 60*a* is moved from the contacts "open" position, as illustrated in FIG. 1, to the contacts "closed" position, as illustrated in FIG. 5, the rigidly latched toggle assembly 58 and the movable arm 43 are displaced against the bias of the spring 52, and move the contact 42 into engagement with the stationary contact 44 achieving the contacts "closed" position, as illustrated in FIG. 5.

Once the breaker is switched to the contacts closed position, the circuit can only be interrupted by the sensing of an overload or some other predetermined condition by the electromagnetic actuating device 50. Upon the occurrence of a predetermined overload condition, the electromagnetic device causes the toggle assembly to collapse. The collapse of the toggle mechanism permits the movable contact arm to pivot under the bias of spring 52 to "open" the contacts 42 and 44.

Upon occurrence of a predetermined overload condition, assuming the circuit breaker to be in the contacts "closed" position, an armature 70 which is part of the electromagnetic device 50, is attracted toward the pole piece 72, either after a time delay period or virtually instantaneously, depending on the overload condition. The armature 70 is pivoted on a pin 74 which extends between the frame plates 54. The armature 70 includes an attractable arm 73 and a trip finger 71. When the arm 73 of the armature 70 is attracted toward the pole piece 72, the rotation of the armature moves the trip finger 71 into trip pin 75. Trip pin 75 is part of the latching mechanism holding the two links of the toggle linkage assembly 51 rigid. The trip pin is on a latching lever pivotally supported on a first one of the toggle links and spring biased into a position engaging and holding the second toggle link against a stop on the first link. When the trip pin 75 is engaged, the latching lever moves its latch surface away from the second link, which is then free to move away from the stop on the first. The toggle assembly 58 collapses and under the bias of spring 52 the movable contact arm 43 moves contact 42 to open the contacts 42 and 44. As the bell crank 60 is also moved under the urging of spring 55 to rest against a stop in its contacts open position, as illustrated in FIG. 1, the toggle assembly 58 is thereby positioned to automatically relatch.

The collapse of the toggle mechanism 58 takes place independently of the position of the bell crank 60 so that the circuit breaker cannot be held in the contacts closed position by manually holding the push-button 101 depressed. This capability is known as "trip free" in the art. Upon collapse of the toggle assembly 58, no rigid link is left to hold the bell crank 60 in the position of FIG. 6*d*. Therefore, under the bias of the spring 55 bell crank 60 will rotate to the contacts "open" position, as illustrated in FIGS. 1 and 6*a*, wherein the cam surface 83 is again presented to the pawl 100. The rotation of the bell crank 60 in moving the contacts to open position is limited by the abutment of pin 62 on the movable contact arm 43 with the frame plates 54 as the arm 43 moves contact 42 open after the linkage collapses. As pin 61 on the arm 60*a* of bell crank 60 and pin 57 on the rotatable contact support arm 43 continue to move apart, the collapsed toggle linkage assembly 58 is straightened and relatches into its rigid contact actuating condition. A subsequent depression of the push-button 101 will therefore again operate through the rigid linkage to close the contacts 42 and 44.

From the foregoing description and the accompanying figures, it can be seen that the present invention provides a circuit breaker mechanism which is efficient to use and which is very effective in operation. It will be recognized by those skilled in the art that changes or modifications may be made to the above-described embodiment departing from the broad inventive concepts of the invention. It is understood, therefore, that this invention is not limited to the particular embodiment described, but is intended to cover all changes and modifications which are within the scope and spirit of the invention as set forth in the appended claims.

What is claimed is:

1. A circuit breaker mechanism comprising:

(A) a frame;

(B) a pair of contacts supported relative to the frame, said contacts being displaceable relative to one another between an open and a closed position;

(C) a bell crank pivotable on said frame between a first and second stable position, said bell crank having a deflecting surface and a cam surface;

(D) a linkage assembly coupled with said bell crank and at least one of said contacts, said linkage assembly being displaceable to open and close said contacts;

(E) a push-button actuator movably supported relative to said frame, said push-button actuator being adapted to engage the cam surface of the bell crank in its first stable position to displace said bell crank from the first stable position into its second stable position so as to displace said linkage assembly to close said contacts, and said push-button actuator being adapted to engage the deflecting surface of the bell crank in the second stable position so that the push-button actuator is deflected by the deflecting surface of the bell crank to prevent displacement of the bell crank from its second stable position; and (F) an electrical actuator on said frame for acting on said linkage assembly under predetermined conditions to open said contacts and enable displacement of said bell crank from the second stable position to its first stable position.

2. The breaker mechanism in accordance with claim 1 wherein said push-button actuator comprises a retractable pawl for engaging the cam surface of the bell crank in its first stable position and said cam surface of said bell crank includes a stop against which said pawl engages so that further movement of the pawl displaces said bell crank into its second stable position.

3. The breaker mechanism in accordance with claim 1 wherein said push-button actuator includes a retractable pawl for engaging the deflecting surface of the bell crank in its second stable position and wherein said deflecting surface deflects the retractable pawl so that the pawl upon engagement of the deflecting surface is unable to displace the bell crank from its second stable position.

4. The breaker mechanism in accordance with claim 1 wherein said breaker mechanism comprises a contact-carrying arm carrying one of said contacts movably mounted relative to the frame and spring biased to move away from closed contact position, and wherein said linkage assembly comprises at least a pair of pivotally connected links and a displaceable latching mechanism latching the links rigidly together in an extended position, said linkage assembly being pivotally connected respectively to said bell crank and to the contact-carrying arm, said contact-carrying arm being adapted to move against spring bias in response to displacement of the latched linkage assembly to open and close said contacts, and wherein said electrical actuator includes means responsive to overload conditions for tripping said latching mechanism causing collapse of the linkage assembly to allow the contact carrying arm to open the contacts.

5. The breaker mechanism in accordance with claim 1 comprising a tubular guide for the push-button supported relative to the frame and wherein said push-button actuator includes:

(A) a depressable push-button slidably engaged and movable back and forth within said tubular guide;

(B) stop means to limit the movement of the push-button;

(C) a return spring supported by said tubular element and engaging and urging said push-button from a depressed position to an initial undepressed position; and (D) a pawl pivotally connected to the push-button at one end and movable into engagement with said bell crank.

6. The breaker mechanism in accordance with claim 5 wherein said connecting means includes a pin pivotally connecting said pawl element with said push-button; and means for centering said pawl element relative to said push-button.

7. The breaker mechanism in accordance with claim 6 wherein said tubular element is provided with guide slots and end portions of said pin are engaged in said slots to limit axial movement of the push-button and pawl element relative to the bell crank.

8. The breaker mechanism in accordance with claim 6 wherein said means for centering said pawl element includes a centering piston slidably supported within a conforming guide cavity in said push-button aligned with said pawl and a centering spring within the guide cavity for urging said centering piston into the pivotally supported end of said pawl element, said centering piston and the end of said pawl element having abuting surfaces such that when said pawl moves out of alignment, its end moves the piston against the bias of the spring.

9. The breaker mechanism in accordance with claim 1 wherein said bell crank includes a cam hub pivotally mounted on the frame providing said deflecting surface and said cam surface with a stop and an arm portion projecting from said hub pivotally connected with the linkage assembly to displace said linkage assembly upon displacement of the bell crank; and wherein said push-button actuator includes a retractable pawl for engaging the stop on the cam surface in one position and the deflecting surface in the other position.

10. The breaker mechanism in accordance with claim 9 wherein said cam surface terminates in a shoulder stop for opposing the push-button actuator and the deflection surface provides a surface for deflecting the push-button actuator.

* * * * *